US006039593A

United States Patent [19]

Chen

[11] Patent Number: 6,039,593

[45] Date of Patent: Mar. 21, 2000

[54] LAMP BASE STRUCTURE OF A SERIES OF CHRISTMAS LAMPS

[76] Inventor: Ching Chao Chen, No. 511, Sec. 3, Ton-Ta Rd., Hsin-Chu City, Taiwan

[21] Appl. No.: 09/012,222

[22] Filed: Jan. 23, 1998

[51] Int. Cl.[7] ..... H01R 13/52

[52] U.S. Cl. ..... 439/280; 439/419

[58] Field of Search ..... 439/419, 271, 439/280

[56] References Cited

U.S. PATENT DOCUMENTS

| | | | |
|---|---|---|---|
| 5,660,560 | 8/1997 | Cheng et al. | 439/419 |
| 5,762,519 | 6/1998 | Hwang | 439/419 |
| 5,876,236 | 3/1999 | Chen | 439/419 |

*Primary Examiner*—Paula Bradley
*Assistant Examiner*—Tho D. Ta
*Attorney, Agent, or Firm*—Harold L. Novick; Nath & Associates

[57] ABSTRACT

A lamp base structure of a series of Christmas lamps, wherein a through hole and an engaging hole are installed on the central portion and the near rim portion of the groove seat, respectively, while a central conducting piece and an outer conducting piece are installed in the through hole and the engaging hole. An engaging groove is formed on the inner peripheral wall of the lamp base corresponding to said engaging hole. A bent portion is formed between the upper end penetrating portion and the lower end portion of the outer conducting piece, and the penetrating portion is shifted toward the center of the lamp base groove. An engaging block is engaged in the gap of the engaging hole above the bent portion of the outer conducting piece, wherein the width of said groove engaging hole corresponds to the length of the bent portion between the lower end portion and the upper end penetrating portion of the outer conducting piece. A protrusion is located on the upper end penetrating portion of the outer conducting piece. A gap is located between the protrusion and the lower end portion. An engaging block fits snugly in the gap and has a length greater than 1 mm. Thus the present invention will attain a preferred water-proof effect.

5 Claims, 2 Drawing Sheets

LAMP BASE STRUCTURE OF A SERIES OF CHRISTMAS LAMPS

BACKGROUND OF THE INVENTION

1. Field of the Invention

The present invention relates to a lamp base structure of a series of Christmas lamps, especially to a lamp base the outer conducting piece of which has a preferred water-proof effect.

2. Description of the Prior Art

In the prior lamp base structure of a series of Christmas lamps, metal conducting pieces (positive and negative) are engaged on the center of the seat and the peripheral wall of the lamp base. As the lamp is engaged on a predetermined position of the lamp base, those metal conducting pieces come into contact with predetermined positions of the lamp base, thus the weight of the lamp is reduced.

However, the outer conducting piece engaged on the inner peripheral wall of the lamp base has a plate shape. Therefore, as the conducting piece is engaged in the engaging hole of the peripheral wall of the lamp base, the gap between the conducting pieces and the outer periphery of the lamp base is smaller, approximately 1 mm. If the prior lamp base structure is used as a water-proof structure, it is probable that the water may enter into the lamp from the outer periphery of the lamp base, thus it will not conform with the security standard of U.S. UL 588.

SUMMARY OF THE INVENTION

Accordingly, the present invention provides a lamp base structure of a series of Christmas lamps, wherein a through hole and an engaging hole are installed on the central portion and the near rim portion of the groove seat, respectively, while a central conducting piece and an outer conducting piece are installed on the through hole and the engaging hole. A engaging groove is formed on the inner peripheral wall of the lamp base corresponding to said engaging hole. A bent portion is formed between the upper end penetrating portion and the lower end portion of the outer conducting piece, and the penetrating portion is shifted toward the center of the lamp base groove. An engaging block is engaged in the gap of the engaging hole above the bent portion of the outer conducting piece.

By said lamp base structure, the width of said groove engaging hole corresponds to the length of the bent portion between the lower end portion and the upper end penetrating portion of the outer conducting piece. A protrusion is located on the upper end penetrating portion of the outer conducting piece. A gap is located between the protrusion and the lower end portion. This gap will cause the water outside the lamp base to drain less easily to the outer conducting piece, thus the present invention will attain a preferred water-proof effect.

The present invention will be better understood and its numerous objects and advantages will become apparent to those skilled in the art by referencing the following drawings:

DETAILED DESCRIPTION OF THE PREFERRED EMBODIMENT

Figure 1:
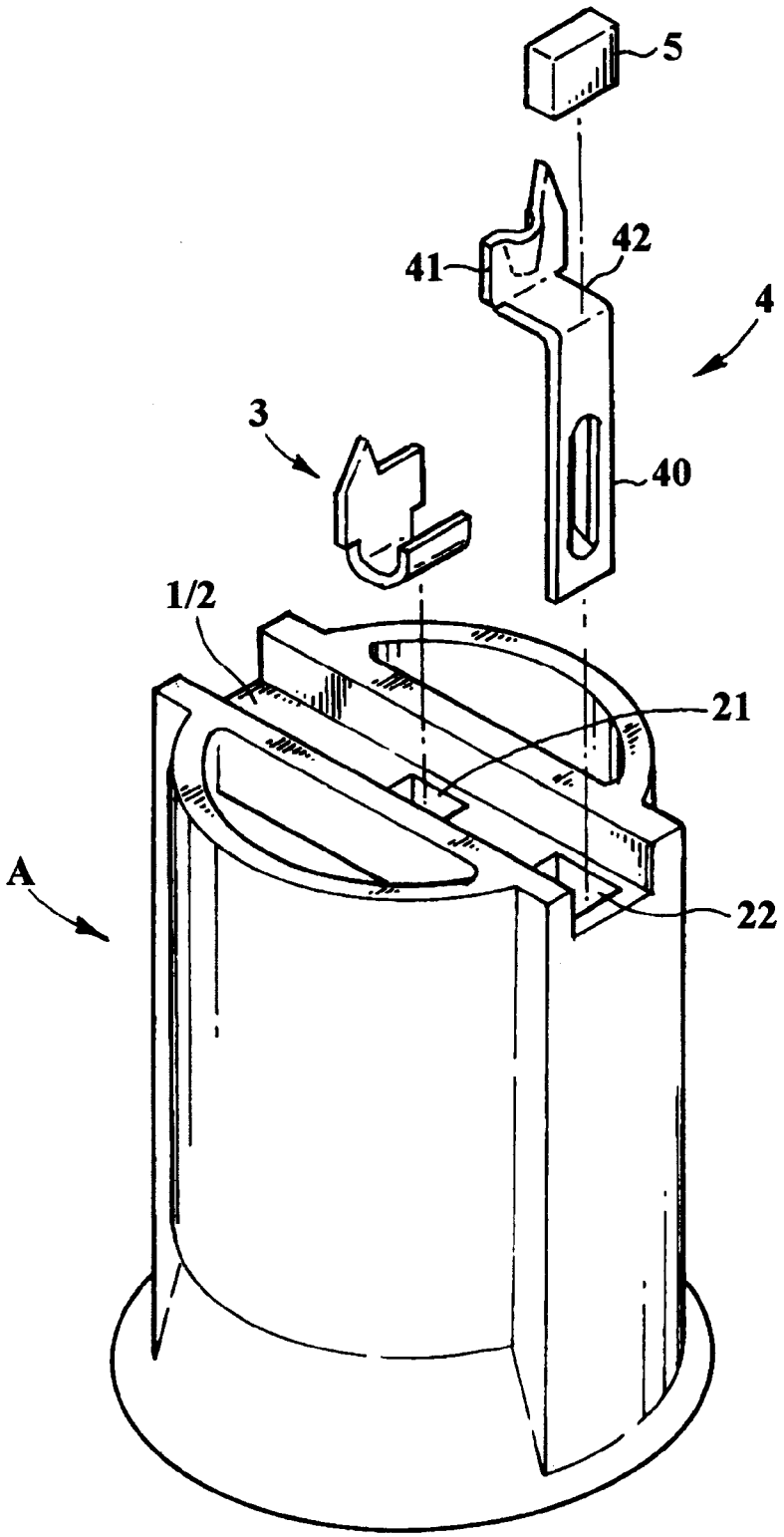
FIG. 1 is perspective view of the present invention.
Figure 2:
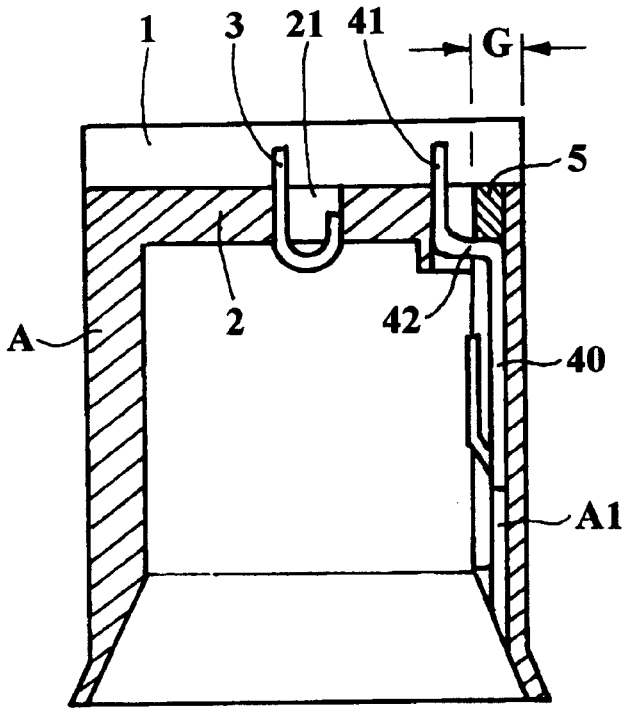
FIG. 2 is a front cross sectional view of FIG. 1.
Figure 3:
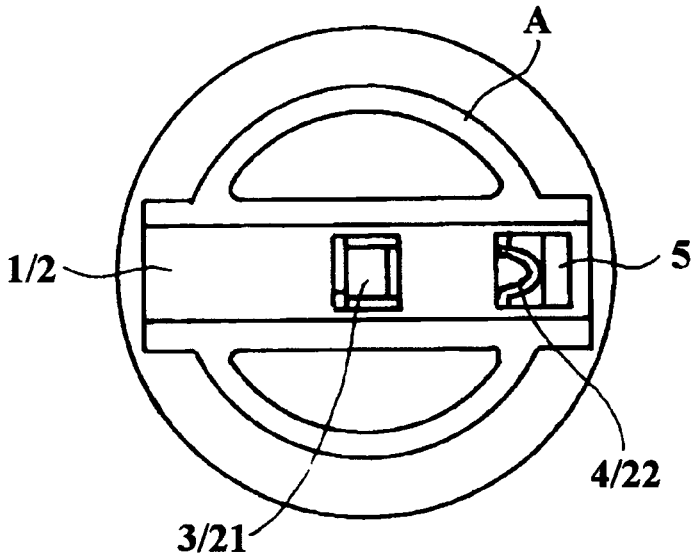
FIG. 3 is an elevational view of the lamp base in FIG. 1.

The details of the present invention may be referred to in FIGS. 1, 2 and 3. In the lamp base (A) of the present invention, a transversal groove (1) is formed on the upper end thereof, and a through hole (21) and an engaging hole (22) are installed on the central portion and the near rim portion of the groove seat (2), respectively. A central conducting piece (3) and an outer conducting piece (4) are installed on the through hole (21) and the engaging hole (22), respectfully, said central conducting piece (3) and outer conducting piece(4) may be contacted with the predetermined position on a lamp (not shown) screwed fixedly on the lamp base (A), thus the weight of the lamp is reduced.

Further, an engaging groove (A1) is formed on the inner peripheral wall of the lamp base (A) corresponding to said engaging hole (22).

Moreover, the lower end portion (40) of the outer conducting piece (4) is engaged on the engaging groove (A1) of the lamp base, and a bent portion (42) is located between the upper end penetrating portion (41) and the lower end portion (40) of the outer conducting piece (4). A protrusion (43) is located on the upper end penetrating portion (41) of the outer conducting piece (4). A gap (G) is located between the protrusion (43) and the near rim portion of the engaging hole (22). The upper end penetrating portion (41) is positioned toward the center of the lamp base groove (1).

The width of said groove engaging hole (22) corresponds to the length (1) of the bent portion (42) between the lower end portion (40) and the upper end penetrating portion (41) of the outer conducting piece (4). Therefore, the lower end portion (40) of the outer conducting piece (4) is engaged within the engaging groove (A1) of the lamp base, the bent portion (42) of the outer conducting piece (4) will enter into the engaging hole (22), while the upper end penetrating portion (41) will be projected upwards from the groove (1).

As the outer conducting piece (4) is engaged on the predetermined position of the lamp base engaging groove (A1), a gap (G) exists between the protrusion (43) and the portion of the engaging hole (22) located on the near rim portion of the groove seat.

An engaging block (5) is engaged in the gap (G) of the engaging hole (22) above the bent portion (42) of the outer conducting piece. Since the engaging block (5) is integrally combined with the groove seat (2), the engaging block (5) will substantially increase the gap between the outer rim of the groove (1) and the outer conducting piece (4), about 3 mm. This longer gap (comparing with that from the prior art) will cause the water outside the lamp base to drain less easily to the outer conducting piece, thus the present invention will attain a preferred water-proof effect.

Although the preferred embodiment of the present invention has been shown and described in detail, it should be understood that various changes and modifications may be made therein without departing from the scope of the appended claims.

What is claimed is:

1. A lamp base structure of a series of Christmas lamps comprising:

a groove located in an end of said base structure, said groove being defined by a groove seat having edge portions located at each end thereof and by sidewalls extending between said edge portions;

a through hole in a central portion of said groove seat and an engaging hole in one of the edge portions of said groove seat, said engaging hole being defined by a first wall portion that is located in a direction toward said groove seat central portion and by a second wall portion that is located in a direction away from said groove seat central portion;

a central conducting piece located in the through hole;

an outer conducting piece located in said engaging hole and comprising, an upper end penetrating portion;

a lower end portion; and a bent portion located between the upper end penetrating portion and the lower end portion so that the upper end penetrating portion is engaged by said engaging hole first wall portion and the lower end portion is parallel to and engages said second wall portion; and an engaging block located on said outer conducting piece bent portion and adjacent to said engaging hole second wall portion.

2. The lamp base structure of a series of Christmas lamps as claimed in claim 1, wherein said upper end penetrating portion includes a protrusion extending in a direction toward said lower end portion; and wherein a gap that is greater than 1 mm is defined by:

said protrusion of said upper end penetrating portion; and said engaging hole second wall portion.

3. The lamp base structure of a series of Christmas lamps as claimed in claim 1, wherein the upper end penetrating portion includes a protrusion extending in a direction toward said lower end portion, said protrusion engaging and securing said engaging block.

4. A lamp base structure comprising:

a groove located in an end of said base structure, said groove being defined by a groove seat having edge portions located at each end thereof and by sidewalls extending between said edge portions;

a through hole in a central portion of said groove seat;

an engaging hole in one of the edge portions of said groove seat, said engaging hole being defined by a first wall portion that is located in a direction toward said groove seat central portion and by a second wall portion that is located in a direction away from said groove seat central portion;

a central conducting piece located in said through hole;

an outer conducting piece located in said engaging hole and comprising, an upper end penetrating portion having a protrusion extending toward said engaging hole second wall portion, a lower end portion, and a bent portion located between the upper end penetrating portion and the lower end portion so that the upper end penetrating portion is closer to said through hole; and an engaging block situated between said engaging hole second wall portion and said protrusion, said engaging block being secured by said protrusion.

5. The lamp base structure of a series of Christmas lamps as claimed in claim 4, wherein the upper end penetrating portion includes a protrusion extending in a direction toward said lower end portion; and wherein a gap that is greater than 1 m is defined by said protrusion, and said engaging hole second wall portion, said protrusion engaging and securing said engaging block in said gap.

* * * * *